United States Patent [19]

Müller

[11] Patent Number: 4,734,728

[45] Date of Patent: Mar. 29, 1988

[54] APPARATUS FOR PROCESSING SHEET FILMS

[75] Inventor: Jürgen Müller, Munich, Fed. Rep. of Germany

[73] Assignee: Agfa-Gevaert AG, Leverkusen, Fed. Rep. of Germany

[21] Appl. No.: 24,378

[22] Filed: Mar. 10, 1987

[30] Foreign Application Priority Data

Mar. 21, 1986 [DE] Fed. Rep. of Germany ..... 3609526

[51] Int. Cl.[4] ..... G03D 3/06

[52] U.S. Cl. ..... 354/324; 354/322; 354/336

[58] Field of Search ..... 354/319, 320, 321, 322, 354/324, 331, 336; 222/132, 382, 464

[56] References Cited

U.S. PATENT DOCUMENTS 4,533,225 8/1985 Shiga ..... 354/336
4,634,252 1/1987 Jeremijevic ..... 354/324
4,641,940 2/1987 Muller et al. ..... 354/324
4,688,917 8/1987 Muller et al. ..... 354/324

FOREIGN PATENT DOCUMENTS

3432077A1 3/1986 Fed. Rep. of Germany .
3535980C1 11/1986 Fed. Rep. of Germany .

*Primary Examiner*—A. A. Mathews
*Attorney, Agent, or Firm*—Michael J. Striker

[57] ABSTRACT

An apparatus for processing of sheet films, comprises developing means for developing sheet films and provided with a plurality of chambers through which the sheet films are movable; pumping means for pumping a processing material; drawer receiving compartment; at least one drawer provided with a plurality of containers for liquids required by the developing means and formed so that upon insertion of the drawer into the receiving compartment a communication is established between the pumping means and a respective one of the containers.

17 Claims, 5 Drawing Figures

APPARATUS FOR PROCESSING SHEET FILMS

BACKGROUND OF THE INVENTION

The present invention relates to an apparatus for processing of sheet films. More particularly, it relates to such an apparatus which has at least one drawer compartment for insertion of a drawer with a processing material, and a developing device for the sheet films with several tanks or chambers arranged above and below the drawer compartment or the drawer compartments, through which the sheet films are moved.

Apparatuses of the above mentioned general type are known in the art. One of such apparatuses is disclosed, for example, in the German document DE-OS No. 3,432,0077, and the developing device is disclosed, for example, in the German document DE-OS No. 3,535,980. The apparatus disclosed in the first mentioned document has the advantage that it can be used in any light space without water or waste and actions, while the chemicals and the water from containers can be protected in the development tank and the waste water can be discharged in removal containers. However, it possesses the disadvantage that the used chemicals must be discharged and fresh chemicals must be filled and there is no possibility for regenerating the chemicals by their repumping to the apparatus.

SUMMARY OF THE INVENTION

Accordingly, it is an object of the present invention to provide an apparatus for processing sheet films which avoids the disadvantages of the prior art.

More particularly, it is an object of the present invention to provide an apparatus for processing sheet films in which a recycling and regeneration of the liquid of the developing device is possible, handling of the apparatus and especially the readiness of the regenerate-liquid is possible and particularly putting in readiness of the regenerated liquid is performed in a simple manner, and use in any location is possible without special skills.

In keeping with these objects and with others which will become apparent hereinafter, one feature of the present invention resides, briefly stated, in an apparatus for processing of sheet films in which a drawer compartment is provided with a drawer in which parallel containers with liquids required for the developing device are insertable, the drawer or containers arranged therein is associated with a circulating pump provided between a tank and the associated container, and there is a conduit between the circulated pump and the associated container which is automatically provided during insertion of the drawer.

In accordance with the invention the regenerate-liquids are arranged in containers in a drawer which is insertable into a drawer compartment and can be carried in a briefcase-like manner, and during insertion of the drawer into the respective compartment in the apparatus, the containers are automatically connected to the circular pump provided in the apparatus. Thereby the supply and withdrawal of developer solutions and regenerate-liquids is performed in a simple manner in areas without fresh water and waste water supply, or in which long conduits were required for fresh water and waste water supply.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
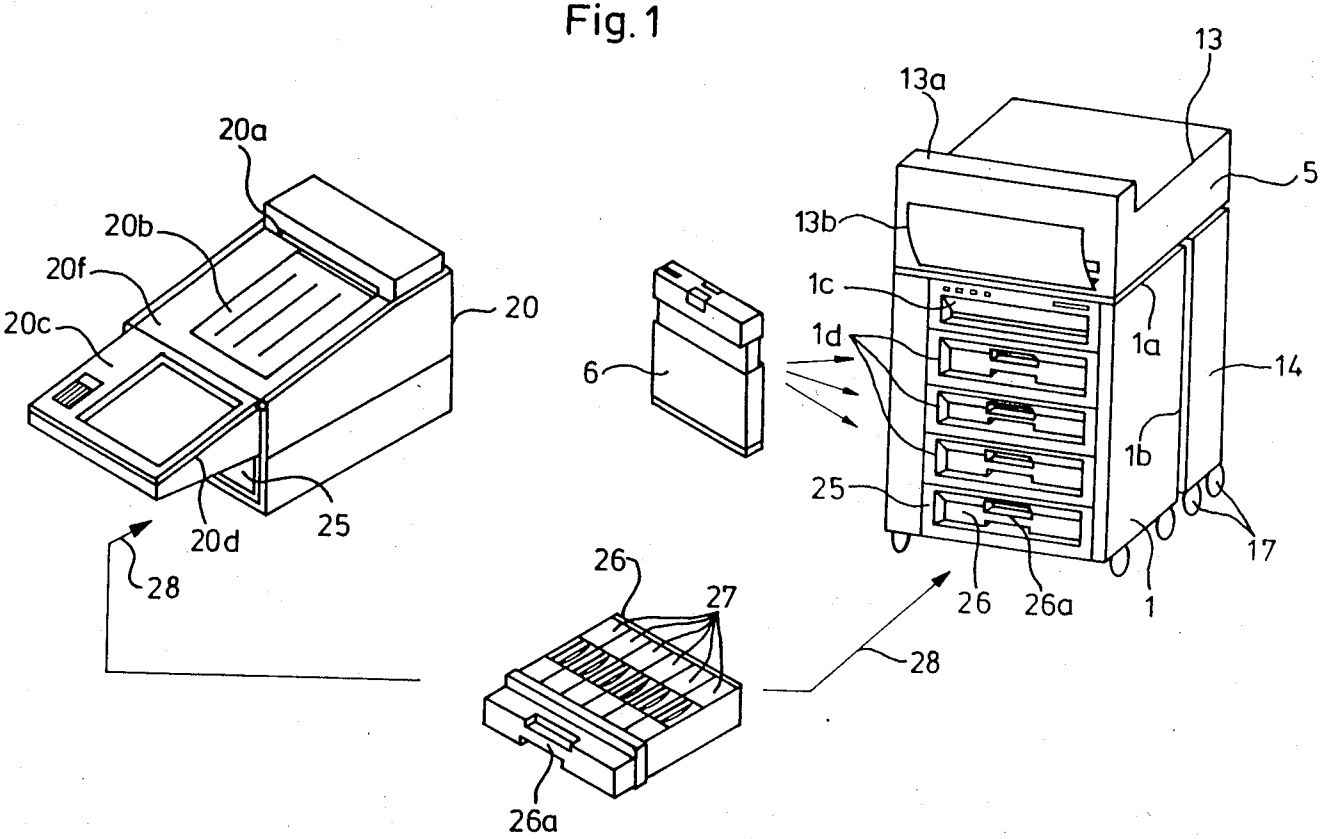
FIG. 1 is a perspective view of an inventive apparatus for processing sheet films, provided with a drawer which has chemicals containers.
Figure 5:
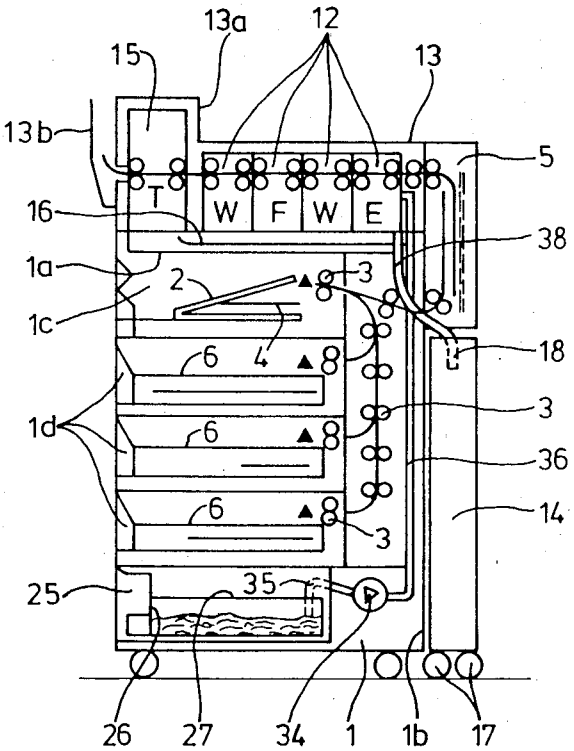
FIG. 5 is a schematic broken view of an apparatus in accordance with another embodiment of the invention.

FIGS. 1 and 5 show an x-ray film cassette loading and unloading apparatus 1. Its upper side is identified with reference 1*a* and its rear side is identified with reference 1*b*. An x-ray sheet film cassette 2 is insertable into its upper compartment 1*c* and opened automatically in a light-tight region. An illuminated film 4 which located in the open cassette 2 is supplied via a suction element to transporting roller pairs 3 which transport the illuminated film 4 from the compartment 1*c* to a housing part 5 projecting over the upper side 1*a* and the rear side 1*b*. Further compartments 1*d* are located under the compartment 1*c* and used for so-called dispenser magazines 6 in which films of different formats are inserted. The cassette's format is automatically determined in a known manner, and after emptying a cassette 2 the non-illuminated film of the respective format is supplied from the respective dispenser magazines 6 into the cassette 2. The latter is closed and transported from the compartment 1*c*. Transporting roller pairs serve for this purpose. Instead of the shown cassette loading and unloading device 1, a picture screen receiving device can be used in the present invention, which contains the compartments for dispenser magazines for different sheet film formats.

The housing part 5 is smaller than the apparatus 1 and projects above its upper side 1*a* and rearwardly over the side 1*b* in correspondence with the height of development tank or fixing and watering tank 12 and their cover 13, as well as in correspondence with the depths of the optimally measured waste water container 14. Drying chamber 15 can be connected with the tank 12 at the front side of the apparatus so as to provide a higher housing part 13*a*, and is provided with aeration slots. The higher housing part 13*a* has a catching basket 13*b* at the front side of the apparatus for developed and dried films 4. The housing part 13 which covers the tank 12 for a complete developing device extends between the upper side 1*a* of the housing and the further housing part 5 flush the same and completes the housing so as to form a compact apparatus for treatment or production of an illuminated sheet film 4 and its development. An accumulating trough 16 is arranged directly over the upper side 1*a* of the device 1 to prevent damages 1 or its film dispensing magazine 6 in the event of untightness of developing liquids in course of time or overflow during filling of the tank 12. The size of the trough 16 is dimensioned so that it extends over the width and length of the flat region corresponding to the tank 12 and the dripping region of the drying device 15. As a result of this all dripping or overflowing liquid is collected in the trough 16.

The waste water container 14 stands on wheels 17 and has such a dimension that it is displaceable under the further housing part 5 on the rear wall 1*b*. It can be locked in the position of use with the rear wall 1*b* by a releasable locking device. The waste water container 14 can have several chambers, so that different liquids in the tank 12 can be collected in accordance with their further use or discarding, separately in the container 14. The waste water container can be provided with an outlet for discharging of the waste water or recirculating the same.

Flexible conduits 38 extend from the individual tanks 12 and the accumulating trough 16 laterally near the transporting rollers 13 and the compartments 1*c* and 1*d*. They lead inside the housing 13, 1 to the waste water container 14 and its chambers. Naturally, a drain 18 of the tank 12 must be closable manually by a not-shown faucet.

Figure 3:
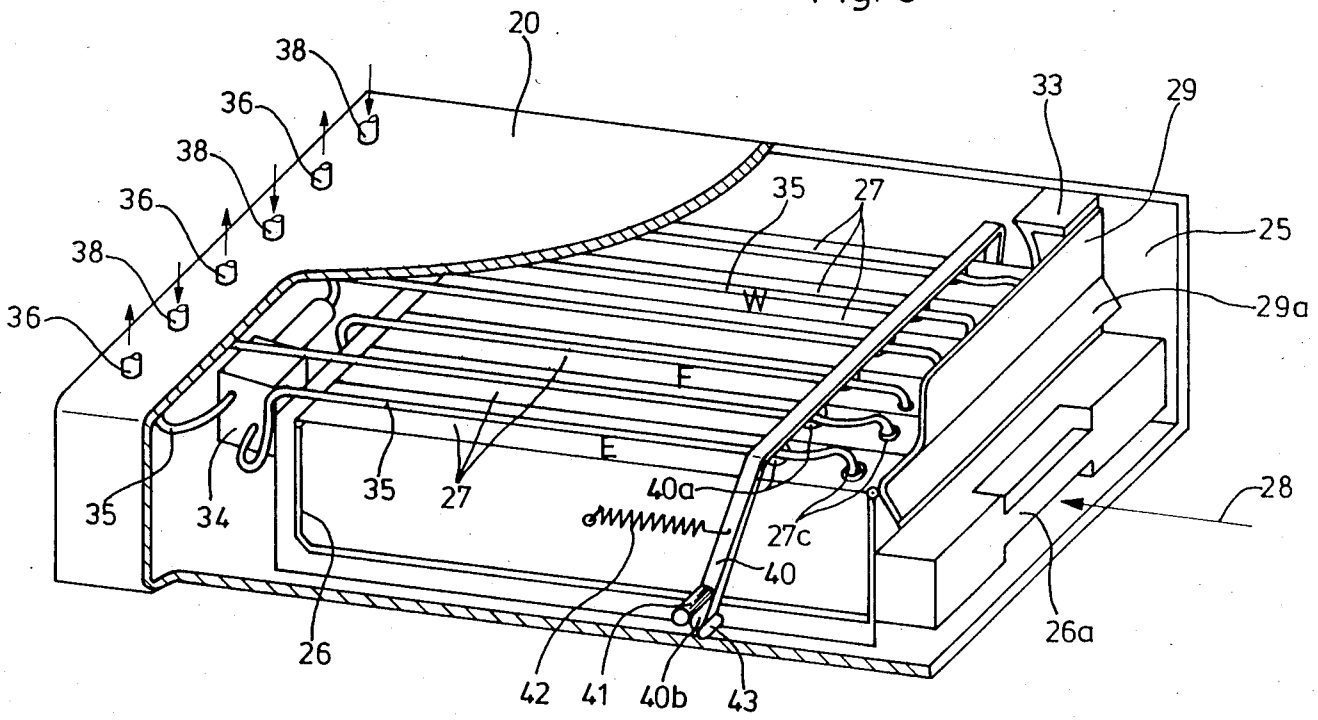
FIG. 3 is a view broken perspective view of an embodiment of an inventive drawer compartment with inserted and closed drawer with chemicals containers.

FIGS. 1 and 3 also show a sheet film developing device 20 formed as a table device which does not require direct conduits for a fresh water and waste water and is suitable, similarly to the device 1, the use in the inventive apparatus. The parts of the device 20 which cooperate with the parts of the device 1 are identified with the same reference numerals. Chambers 12 for development, fixation and watering and a drive 15 are arranged in the upper part of the developing device 20. The containers 12 can be formed for example in correspondence with the German document DE-OS No. 3,432,077 and therefore is not described here in detail. An inclined accumulating trough 20*b* for finished film sheets is arranged under a discharge slot 20*a* of the drier. The extension 20*c* of the trough 20*b* is vertically turnable and serves as a cover for a feeding desk 20*d* of a feeding slot 20*e* of the developing device 12. The small developing device 12 is formed as a dark chamber device for manual feeding of sheets to be developed. A desk 20*f* is arranged in the accumulating trough 20*b* and can be open in a not-shown manner to clean the chamber 12.

In both shown devices 1 and 12, as well as in other devices of this type such as the above described picture screen device with compartments for sheet films of different types and the developing device arranged on it, there is a requirement for the developing in that the developing chemicals and water are to be either regenerated or pumped to the chambers 12 as is the case in the device 20. For performing it in completely safe and simple manner in areas without fresh water and waste water conduits, a compartment 25 is provided in each of the devices 1 and 20. This compartment is arranged preferably under the developing device 12. With presence of several compartments 1*c*, 1*d*, 25, the compartment 25 is advantageously the lowest compartment. A drawer 26 is insertable into the compartment 25. It has several parallel liquid containers 27 which are arranged firmly and at the same time exchangeably in the drawer.

Figure 4:
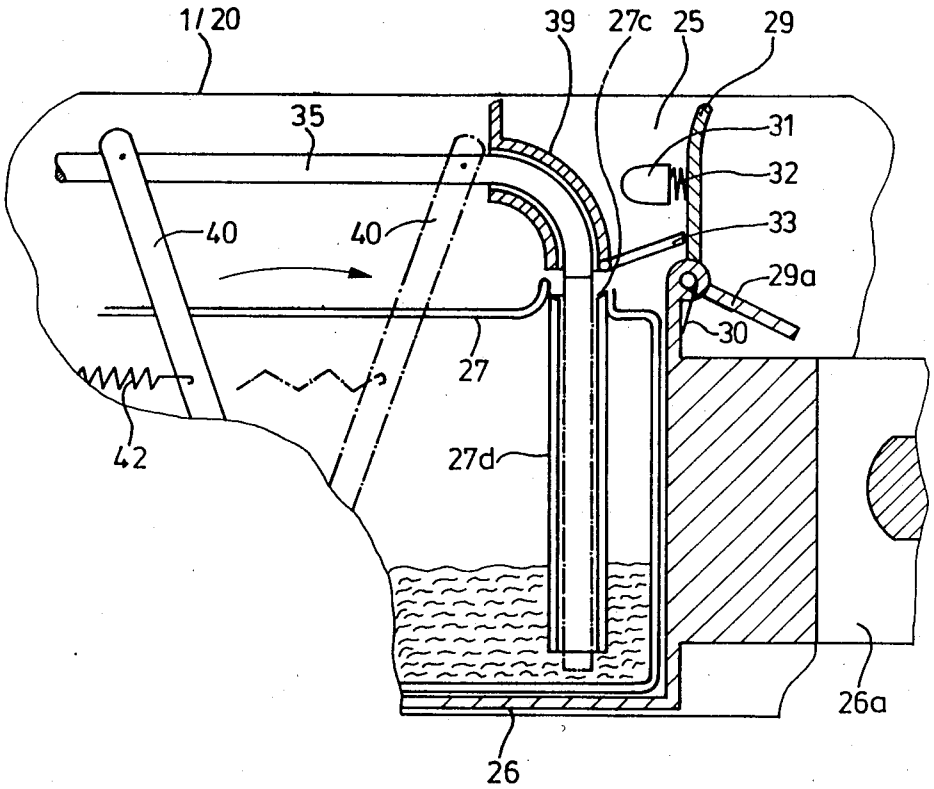
FIG. 4 is a view showing a fragment of FIG. 3, on an enlarged scale.

In accordance with the shown embodiment, the liquid containers 27 extend parallel to one another in the drawer 26 as seen in an insertion direction 28. For the device 1, it is sufficient to have in the drawer 26 three liquid containers 27 for developing liquid E, fixing solution F and water W since the waste water is discharged in the waste water container 14. Since the developing device 20 has no waste water container, six liquid containers 27 are provided in the drawer 26 for this device 20, namely a full container for the developer E, a neighboring initially empty container for return of the used developer liquid, a third full container for fixing solution F, a neighboring initially empty container for the return of used fixer solution, a fifth initially full container with a washing water W, and a sixth initially empty container for the return of the washing water. With the exception of this different arrangement, the drawers 26 with the containers 27 are identical in their operation in the devices 1 and 20, and in the embodiments of FIGS. 2 and 4 there are six containers 27.

Advantageously the compartments 25 and the drawers 26, disregarding their different contents, are similar in all devices 1, 20 of this type, so that they can be stored in small numbers. This is possible since the sheet film formats are standardized. Each drawer 26 is provided with a supporting bracket 26*a* in its end side which is opposite to the insertion direction 28. The containers 27 fit in them or secured by snap or lock connection so that the filled drawers can be carried as carrying cases. The drawers 26 can be supplied with full, or full and empty containers, so that a consumer does not have to have any contacts with liquids.

A special design of a container 27 is described herein below. It is advantageous when the container 27 has a handle or supporting bracket 27*a* and subdivided by an intermediate wall 27*b* which extends downwardly but does not reach the bottom, for reducing turbulence during pumping out of the liquids. Moreover, the container 27 is provided with filling and discharging opening 27*c* at the same point. A raiser pipe 27*d* can extend downwardly for the reducing the oxidation. It has a considerable width but does not reach the container bottom. The individual openings 27*c* are arranged in one row with the containers 27 inserted in the drawer 26. Prior to the insertion they are closed by plugs or screw closures.

After the insertion of the containers 27 in the drawer 26, the plugs are removed. For this purpose an angular plate 29 is supported turnably on the drawer 26 along the row of the openings 27*c*. A spring 30 engages one lever arm 29*a*. It urges the other lever arm to be pressed against the openings 27*c*. A stopper 31 is arranged on the other lever arm for each container 27, with interposition of a pressure spring 32. When the individual plugs of the containers 27 inserted in the drawer 26 are removed, the angular plate 29 moves under the action of the spring 30 against the container openings 27*c*. The stoppers 31 are pressed under pressure in the openings 27*c* and tightly close the latter. Thereby the drawer 26 filled with the containers 27 can be carried in a carrying case.

The drawer 26 of the device 1 or 20 is provided with a running on surface 33 in at least one side wall. During closing of the drawer 26 in the compartment 25 of the device 1 or 20, the projecting end of the angular plate 29 which extends over the stoppers 31 runs against the running-on surface 33 and is turned upwardly against the action of the spring 30, so that the stoppers 31 automatically are removed from the openings 27*c* and also turned upwardly. The openings 27*c* are released. During withdrawal of the drawer 26 from the compartment 25, the openings 27*c* are again automatically with the stoppers 31 under the action of the spring 30. A pump 34 is arranged behind each container 27 which contains the regenerate or exchange liquid. A suction conduit 35 extends from the pump 34 along the container to the region of the openings 27c. An outlet conduit 36 of each pump 34 leads to the respective supply opening 37 of the respective container or the respective developing chamber 12. Waste conduits 38 of the individual tanks or developing chambers 12 lead, depending on the type of the device, to the waste water container 4 or its inlet conduit 18, or to the conduit 35 of the respective empty container 27 in the drawer 26, which are provided for receiving the waste liquids.

Figure 2:
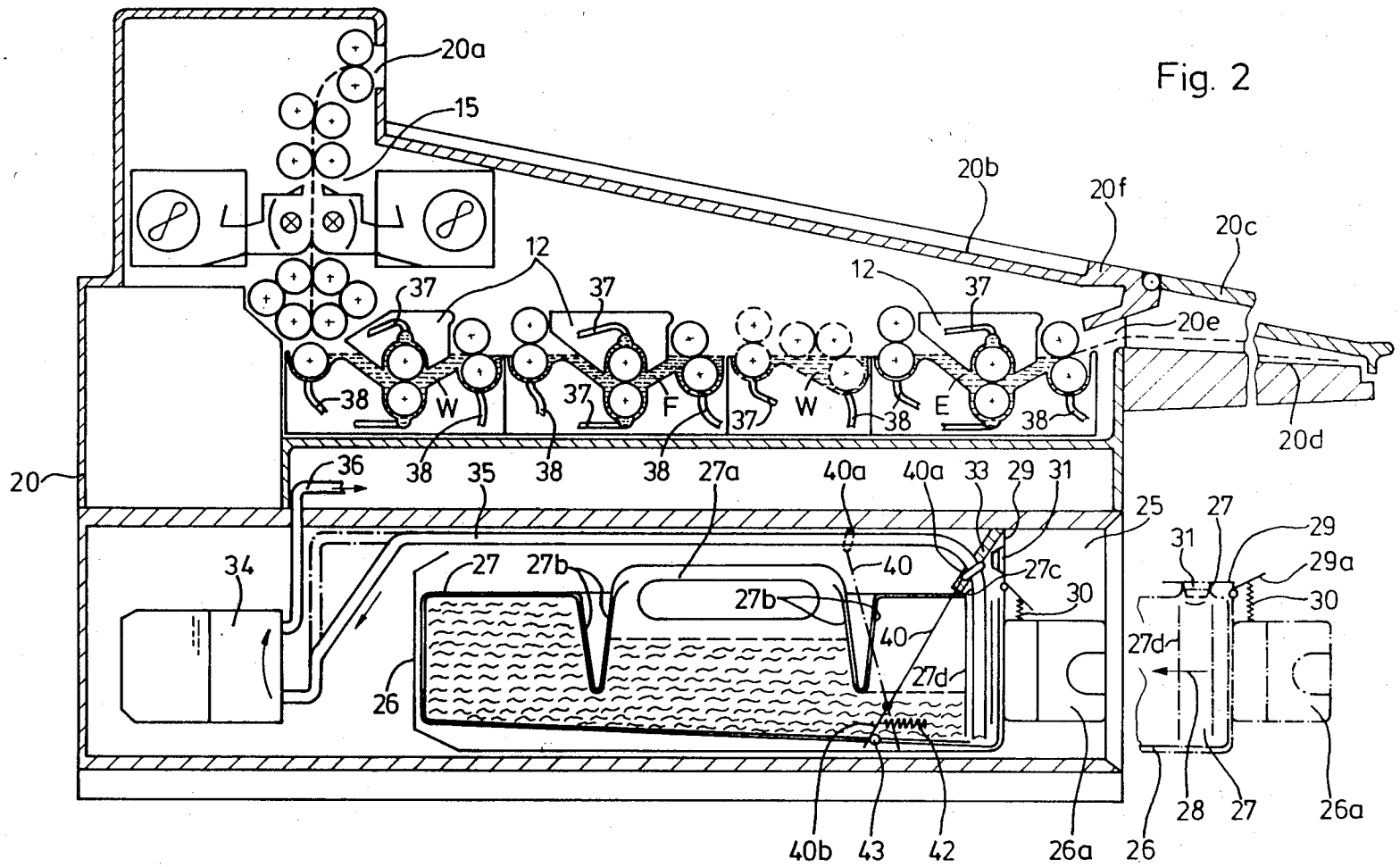
FIG. 2 is a view showing a section of a sheet film table developing device in accordance with the invention.

The suction conduits 35 which lead from the pump 34 to the containers 27 extend parallel and opposite to the insertion direction 28 of the drawer 26 in the compartment 25, to the row of openings 27c which in the shown embodiment extend vertically. Directly above the openings 27c in their open condition shown in FIG. 4, a deflector 39 is provided in each chamber for the conduits 35 which is shown in half in the drawing in order not to obstruct the visibility. When the drawer 26 is not inserted in the compartment 25, the suction conduit 35 lies with its ends in the deflector 39 and near the pump 34 are angled or bent in a loop as shown in FIG. 2 in broken lines. A bracket 40 is supported in the compartment 25 turnably about an axis 41 and stands under the action of a spring 42. An ear 40a is provided in the bracket 40 for each conduit 35 so as to block and mount the conduits 35. When a known drawer 26 is inserted in the compartment 25, the bracket 40 assumes the position which is shown in broken lines in FIG. 2 and in solid lines in FIG. 4. Correspondingly the conduits 35 lie in the loop shown in broken lines in FIG. 2 and lie with their ends in the deflector 39 in the position shown in solid lines in FIG. 4.

When the drawer 26 is inserted in the compartment 25, its control pin 33 acts upon a free end 40b of the bracket 40 and turns the same in clockwise direction. Thereby the conduits 35 mounted in the ear 40a and connected with the pump 34 or the conduits 35 connected with the outflow 38 are displaced in the deflector 39, automatically inserted into respective openings 27c and displaced in the pipe 27d close to the bottom of the containers 27, as shown in broken line. Thus the insertion of the drawer 26 automatically establishes the connection of the pump 34 or the outflow conduits 38, so that the device 1 or 20 is made ready without additional handle only by insertion of the drawer. During withdrawal of the drawer 26, the above described process takes place in reverse order under the action of the spring 42, so that the conduits 35 are again withdrawn from the openings 27c.

While the drawings show an exemplary embodiment of the invention, it is possible to provide further embodiments which are not shown for the sake of simplicity. For automatic opening of the stoppers 31 any known device can be used, for example electric magnets which in response to reaching the end position by the drawer 26 are actuated and lift the stoppers 31 mounted on the magnets. For insertion of the conduits 35 into the openings 27c, other automatic devices can be used for displacing the conduits. The containers 27 must not necessarily extend parallel to the insertion direction of the drawer 26, but instead then they can be arranged normal to the same. It is also possible to provide the openings 27c which lead to the pumps along one compartment side and the openings 20c connected with the waste water conduits 38 on the other side of the compartment. In this case two stopper carriers 29 can be provided and turned during or after the insertion of the drawer 26, for example by magnets. With the containers arranged transverse to the insertion direction, the introduction can be performed by a motor via a control.

It will be understood that each of the elements described above, or two or more together, may also find a useful application in other types of constructions differing from the types described above.

While the invention has been illustrated and described as embodied in a an apparatus for processing sheet films, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An apparatus for processing of sheet films, comprising developing means for developing sheet films and provided with a plurality of chambers through which the sheet films are movable; pumping means for pumping a processing material; means forming at least one drawer receiving compartment; at least one drawer provided with a plurality of containers for liquids required by said developing means and formed so that upon insertion of said drawer into said receiving compartment a communication is established between said pumping means and a respective one of said containers.

2. An apparatus as defined in claim 1, wherein said pumping means include a plurality of circulating pumps: and further comprising a plurality of conduits formed so that in response to the insertion of said drawer said conduits connect said circulating pumps with said containers.

3. An apparatus as defined in claim 1; and further comprising a transmission element which is actuating during insertion of said drawer and thereby activates the communication between said pumping means and said containers.

4. An apparatus as defined in claim 1, wherein said chambers are provided with outflow conduits, some of said containers being filled with fresh liquids and connectable with said pumps, the other of said containers being empty in an initial position and automatically connectable with said outflow conduits of said chambers during insertion of said drawer.

5. An apparatus as defined in claim 1; and further comprising a movable waste water container, said chambers having outlet conduits connectable with said waste water container.

6. An apparatus as defined in claim 5; and further comprising a housing, said waste water container being incorporated in said housing.

7. An apparatus as defined in claim 1, wherein said containers are identical and provided with filling and emptying openings arranged in one row.

8. A device as defined in claim 7; and further comprising means for closing said filling and emptying openings, said closing means including a plurality of stoppers, a lever which carries said stoppers, and at least one pressure spring acting upon said lever.

9. An apparatus as defined in claim 8; and further comprising means forming a running-on surface arranged so that during insertion of said drawer said lever is displaceable by said running-on surface and said stoppers turn against the action of said spring from said filling and emptying openings of said containers.

10. An apparatus as defined in claim 9, wherein said lever is formed as a turnable angled plate on which all said stoppers are arranged.

11. An apparatus as defined in claim 1, wherein said containers are provided with filling and emptying openings; and further comprising a plurality of conduits arranged to establish said communication, deflecting guiding means which guide said conduits during insertion of said drawer, and a transmission formed so as to move said conduits with guidance by said guiding means into said filling and emptying and openings.

12. An apparatus as defined in claim 11, wherein said guiding means includes a curved pipe-shaped deflector, said transmission including a rod arranged in an insertion path of said drawer, and a spring acting upon said rod.

13. An apparatus as defined in claim 11, wherein said conduits have conduit ends; and further comprising a turnable bracket which is engaged with said containers and supports said conduits and also has a free end which is bringable in engagement with said drawer, said drawer having a projecting member with which said free end of said bracket is bringable in engagement.

14. An apparatus as defined in claim 1, wherein said drawer is insertable into said receiving compartment in an insertion direction and said receiving compartment has a rear side, said containers being provided with filling and emptying openings; and further comprising a plurality of conduits establishing the communication, said pumps being located in said compartment behind said rear side, and said conduits extending above said drawer opposite to said insertion direction and parallel to the containers to extend to said filling and emptying openings.

15. An apparatus as defined in claim 1; and further comprising means forming further drawer receiving compartment, and further drawers for loading and unloading of a sheet film cassette and for receiving a sheet film supply stack of different formats, said further drawer compartments and said further drawers being arranged above said first mentioned drawer compartment and above said first mentioned drawer with said containers.

16. A drawer for an apparatus for processing of sheet films with developing means for developing sheet films provided with a plurality of chambers through which the sheet films are movable, and with pumping means for pumping a processing material, the drawer comprising a drawer part insertable into a receiving compartment in an insertion direction; a plurality of containers arranged in said drawer part for liquids required by the developing means and formed so that upon insertion of said drawer into said receiving compartment a communication is established between the pumping means and a respective one of said containers, said drawer part having a rear side as considered in said insertion direction; and a handle provided on said rear side of said drawer part.

17. A container for a drawer insertable into a drawer receiving compartment of an apparatus for processing of sheet films with developing means for developing sheet films and provided with a plurality of chambers through which the sheet films are movable, and with pumping means for pumping a processing material such that upon insertion of the drawer into the receiving compartment a communication is established between the pumping means and the container, the container comprising a container part which is flat and elongated, and has an upper part formed as a handle.

* * * * *